US008414277B1

(12) United States Patent
Hollars

(10) Patent No.: US 8,414,277 B1
(45) Date of Patent: Apr. 9, 2013

(54) MANUAL PUMP ALSO CAPABLE OF DISPENSING HIGH PRESSURE COMPRESSED GAS CARTRIDGES

(75) Inventor: Anthony Scott Hollars, Tucson, AZ (US)

(73) Assignee: Illinois Tool Works Inc., Glenview, IL (US)

( * ) Notice: Subject to any disclaimer, the term of this patent is extended or adjusted under 35 U.S.C. 154(b) by 687 days.

(21) Appl. No.: 11/480,636

(22) Filed: Jul. 5, 2006

(51) Int. Cl.
*F04B 53/10* (2006.01)

(52) U.S. Cl. ..... 417/570; 417/374

(58) Field of Classification Search ..... 417/553, 417/570, 374; 137/318; 141/104, 105, 329, 141/339
See application file for complete search history.

(56) References Cited

U.S. PATENT DOCUMENTS

| | | | | | |
|---|---|---|---|---|---|
| 3,221,794 | A * | 12/1965 | Acres | 411/353 |
| 5,012,954 | A * | 5/1991 | Will | 222/5 |
| 5,316,055 | A * | 5/1994 | Brimmer | 141/38 |
| 5,476,372 | A * | 12/1995 | Yang | 417/553 |
| 6,267,161 | B1 * | 7/2001 | Barbieri | 141/383 |
| 6,648,027 | B1 * | 11/2003 | Didur | 141/38 |
| 6,883,565 | B2 * | 4/2005 | Marui | 141/18 |

* cited by examiner

*Primary Examiner* — Charles Freay
*Assistant Examiner* — Philip Stimpert
(74) *Attorney, Agent, or Firm* — Dale F. Regelman; Quarles & Brady LLP

(57) ABSTRACT

The present invention relates to a versatile manually-actuated barrel style pump also capable of controllably dispensing a compressed gas cartridge. The current invention addresses the shortcomings of the prior art dual function pumps available providing the user with a more versatile dual function barrel pump integrated with a compressed gas cartridge dispenser as well as addresses the deficiencies from the prior art dual function pumps. Compressed gas cartridge storage methods that incorporate with the pump and user ergonomics and increased user safety will also become evident.

7 Claims, 9 Drawing Sheets

MANUAL PUMP ALSO CAPABLE OF DISPENSING HIGH PRESSURE COMPRESSED GAS CARTRIDGES

CROSS REFERENCE TO RELATED APPLICATIONS

Not applicable.

FEDERALLY SPONSORED RESEARCH

Not applicable.

REFERENCE TO A MICROFICHE APPENDIX

Not applicable.

FIELD OF THE INVENTION

The present invention relates to a versatile manually-actuated barrel style pump also capable of controllably dispensing a compressed gas cartridge.

BACKGROUND OF THE INVENTION

Cylindrical, barrel style pumps have been in use for decades. Some barrel pumps are long and small in diameter therefore capable of pumping to a high pressure. Other barrel pumps are large in diameter and can be found in both long and short versions. Though lower pressure can be achieved with the larger diameter pumps, a greater volume of air can be moved with each pump stroke.

Circa 1990, compressed gas cartridge dispensers began to gain popularity. Out of all applications, one industry in particular that gained popularity with improved, controllable compressed gas cartridge dispensers was the bicycle industry. The advent of controllable compressed gas dispensers finally allowed a cyclist with a flat tire to dispense all or a portion of a high pressure gas cartridge with confidence and for example, prevents tire over-inflation when dispensing a compressed gas cartridge leaving the option to save the unused compressed gas for later use.

Just recently, two companies have introduced barrel pumps featuring an integrated compressed gas cartridge dispensing means in the same pump. This allows the user to manually pump air or controllably dispense a compressed gas cartridge utilizing one piece of hardware.

A company called SAPO produces one such barrel pump also capable of dispensing a compressed gas cartridge. FIG. 1 PRIOR ART conceptually illustrates a side view of the SAPO dual function pump attached to a tire inflation stem. Manual actuation is performed in a linear motion much like most barrel pumps that utilize a sealed piston within the barrel to displace air. A compressed gas cartridge threadably attaches to the dispensing end of the barrel pump at an angle approximately thirty degrees off the barrel axis, designated by the Greek symbol Theta ($\theta$).

Being that the compressed gas cartridge protrudes at an angle $\theta$ from the pump barrel axis, it would be difficult for one to mount the barrel pump on a frame such as on a bicycle frame while a cartridge is attached to the pump. The protruding compressed gas cartridge can easily create mounting interference problems and could negatively get in a rider's way. Also, the spokes on a bicycle wheel can interfere with the user's hands during activation because of limited working space, and additionally, the SAPO dual function pump offers no compressed gas cartridge storage means other than in its threaded dispensing housing. The design lends to mounting the barrel pump on a frame and inconveniently storing both full and consumed compressed gas cartridges somewhere else, such as in a saddle bag or in a rider's jersey pocket.

Additionally, the SAPO barrel pump having the compressed gas cartridge mount at an acute angle $\theta$ off axis from the barrel potentially aligns the cartridge to the user, particularly the user's head when oriented as shown in FIG. 1 PRIOR ART. Should the user rapidly unthread the cartridge from the dispenser, the cartridge could become a dangerous projectile lined up with the user's face or neck. Sometimes, when compressed gas cartridges, particularly those filled with liquefied carbon dioxide are dispensed with the outlet pointing down, form solid frozen carbon dioxide at the cartridge exit hole. The momentary accumulation of solid frozen carbon dioxide at the exit hole can temporarily block the flow of high pressure gas, duping the user to believe that the compressed gas cartridge is empty. A short time later, the solid flow blocking accumulation thaws and once again high pressure gas flows from the cartridge exit hole, effectively turning a compressed gas cartridge into a projectile. The entire cycle of free flow, flow stopping frozen accumulation, and thaw process thus allowing flow once again can occur over moments, potentially corresponding to the amount of time it would take for a user to unthread a compressed gas cartridge from the SAPO pump now capable of becoming a projectile aimed at the user's head.

A company called SKS Metaplast GmbH (hereinafter called SKS) produces another such barrel pump also capable of dispensing a compressed gas cartridge. FIG. 2 PRIOR ART conceptually illustrates the SKS dual function pump. Manual actuation is performed in a linear motion much like most barrel pumps utilizing a sealed piston within the barrel to displace air. A compressed gas cartridge threadably attaches to the dispensing end of the barrel pump at ninety degrees off the barrel axis, designated by the Greek symbol Sigma ($\sigma$).

Being that the compressed gas cartridge on the SKS dual function barrel pump protrudes at a ninety degree angle $\sigma$ from the pump barrel axis, it would be difficult for one to mount the barrel pump on a frame such as on a bicycle frame while a cartridge is attached to the pump. The protruding compressed gas cartridge would cause interference problems with mounting and could annoyingly or unsafely get in a rider's way. Additionally, the SKS dual function pump offers no compressed gas cartridge storage means other than in its threaded dispensing housing. The design lends to mounting the barrel pump on a frame and inconveniently storing both full and consumed compressed gas cartridges somewhere else, such as in a saddle bag or in a rider's jersey pocket.

Additionally, the SKS barrel pump having the compressed gas cartridge mount at a perpendicular angle $\sigma$ off axis from the barrel aligns the cartridge towards a tire sidewall. Opposite the compressed gas cartridge mounting location is a flow actuation valve that also protrudes perpendicular to the barrel pump axis and can be seen in FIG. 2 PRIOR ART. In use, both the compressed gas cartridge and the flow actuation valve are located up against the spokes of a bicycle wheel and/or tire sidewall thus providing limited working space for a user's hands to dispense the compressed gas cartridge.

The current invention addresses the shortcomings of the prior art dual function pumps available providing the user with a more versatile dual function barrel pump integrated with a compressed gas cartridge dispenser.

The following embodiments will describe the present invention as well as exemplify the preferred embodiment. Additionally, with the aid of figures and an understanding of the prior-art, one having ordinary skill in the art will be able to understand and appreciate the gained utility from the embodiments to follow.

OBJECTS AND ADVANTAGES

Accordingly, several objects and advantages of the present invention will be presented in the following paragraphs followed by a thorough disclosure of each aspect in the accompanying embodiments in the DETAILED DESCRIPTION.

In light of the above-mentioned limitations, it is therefore an object of the present invention to exemplify a dual function pump that allows for increased operator safety.

It is another object of the present invention to provide a dual function barrel pump that allows the operator to easily and controllably dispense a compressed gas cartridge with no interference problems.

Another object of the present invention is to teach a method of axially storing a compressed gas cartridge joined with a barrel pump so that the pump remains slim, allowing easy stow on a frame or in a bag.

Additionally, the ability to store a compressed gas cartridge distally on each end of the barrel pump is an objective of the present invention.

Another object of the present invention is to minimize the parts count thus allowing for simplified, easy to manufacture assembly, reducing labor cost, yielding an affordable yet reliable product.

While maintaining the causative principle of the invention, it is another object of the present invention to have similar components manufactured from machined, molded, cast, or other manufacturing method to suit the intended dual function barrel pump specification.

In some embodiments of the invention, another object of the present invention is to allow a compressed gas cartridge to be used as all or part of a functional manual pumping handle.

Additionally, an object of the present invention is to teach dual function barrel pumps capable of manual pumping to high pressures or lower pressures, dictated by the size of the barrel.

Another object of the present invention is to teach a simple method of retaining and sealing a pumping handle to the pump barrel.

Further objects and advantages will become apparent in the following paragraphs. Solely and in combination, the above objects and advantages will be illustrated in the exemplary figures and accompanying embodiments to follow.

SUMMARY OF THE INVENTION

The present invention addresses the deficiencies from the prior art dual function pumps. It will teach compressed gas cartridge storage methods that incorporate with the pump. Also, user ergonomics and increased user safety will also become evident.

BRIEF DESCRIPTION OF THE DRAWINGS

The figures are exemplary of different embodiments of the present invention. Each illustration conveys the invention and is not to be considered as limiting, rather, exemplary to the scope and causative principle of the present invention. Like components in the figures share identical numbering.

DETAILED DESCRIPTION

The following paragraphs will detail several modes including the best mode of the present invention. The exemplary figures and description of the invention as it is exemplified in each figure is representative of the current invention and the scope of the invention disclosure is not intended to be limited by the exemplary teachings. One skilled in the pertinent art realizes that the embodiments to follow may reasonably be combined and/or modified without deviating from the intended spirit of the present invention. Like physical structure in different figures share the same identifying numbers.

Figure 1:
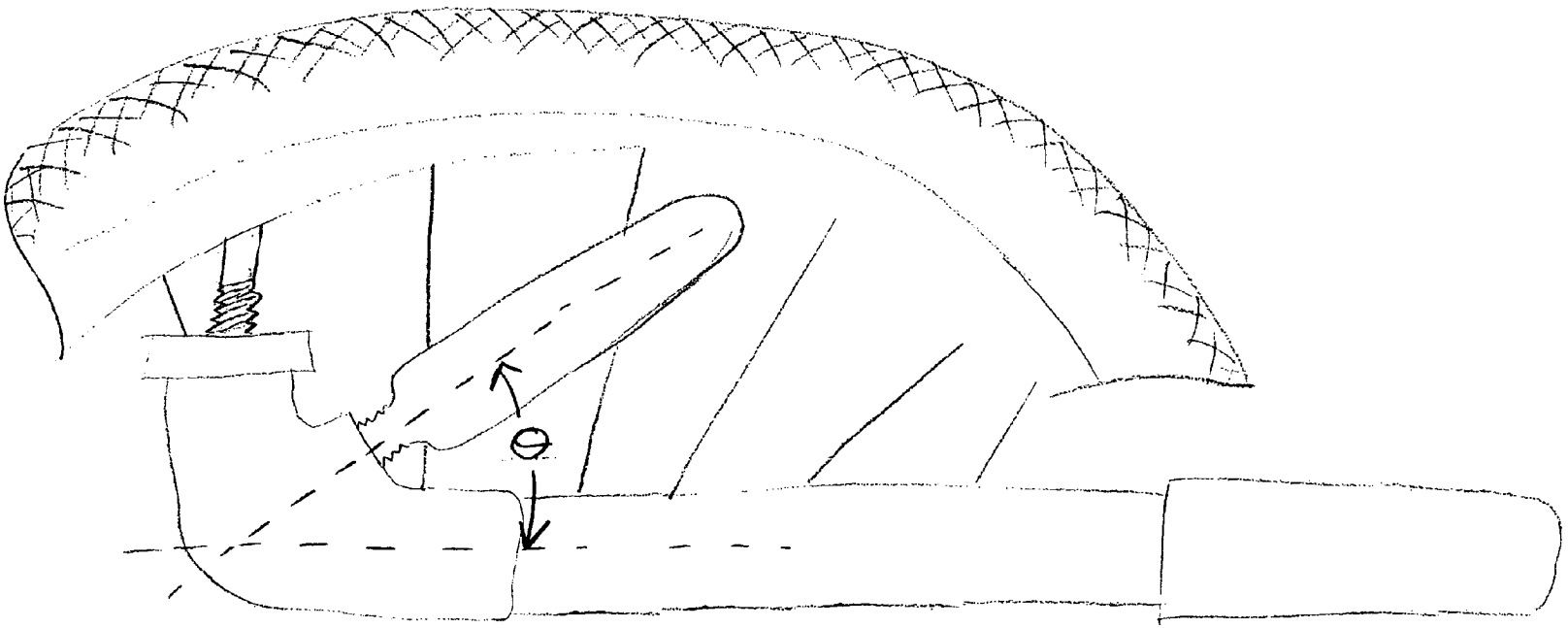
FIG. 1 PRIOR ART
FIG. 1 PRIOR ART illustrates a side view of a dual function barrel pump attached to a tire valve stem; the pump is made by SAPO and is capable of manual pumping as well as dispensing a compressed gas cartridge.
Figure 2:
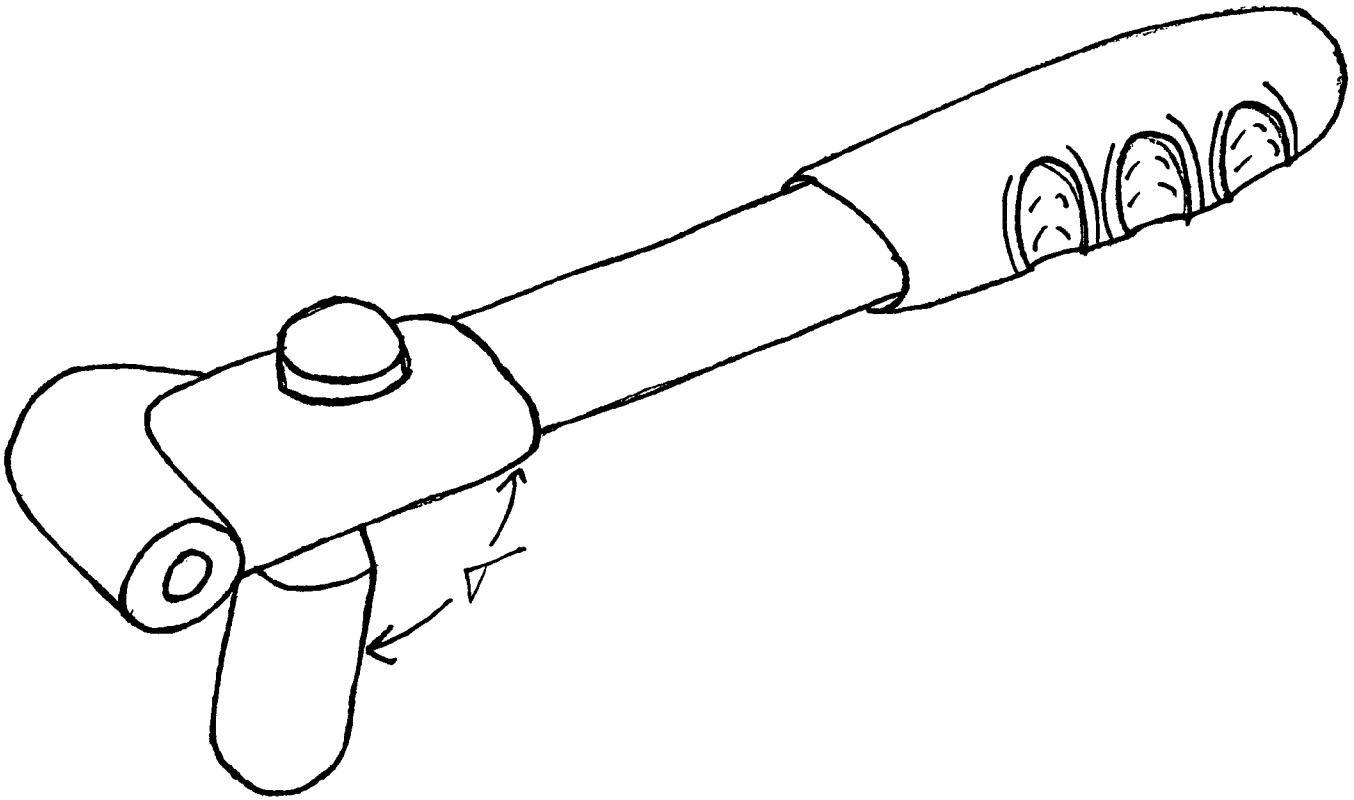
FIG. 2 PRIOR ART
FIG. 2 PRIOR ART illustrates an isometric view of a dual function barrel pump made by SKS, and capable of manual pumping as well as dispensing a compressed gas cartridge.
Figure 3:
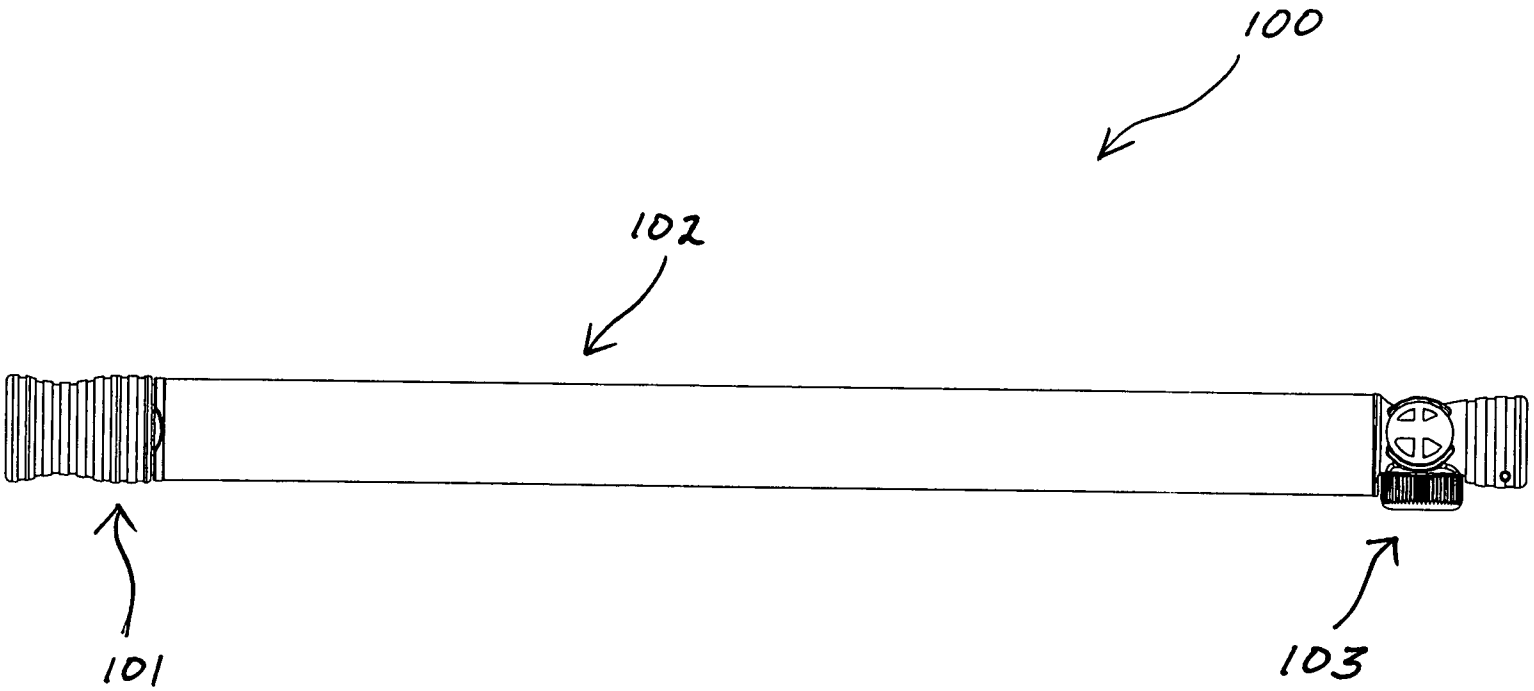
FIG. 3 illustrates a side view of an exemplary dual function barrel pump also capable of dispensing a compressed gas cartridge, in accordance with embodiments of the present invention.

In accordance with an embodiment of the invention, FIG. 3 illustrates a side view of an exemplary dual function barrel pump 100 also capable of dispensing a compressed gas cartridge. Barrel pump 100 comprises a barrel manual handle assembly 101, a barrel section 102, and an inflation head 103. Barrel section 102 and inflation head 103 are rigidly attached and fluidly connected. Manual handle assembly 101 comprises additional components that will be detailed in FIG. 4.

Figure 4A:
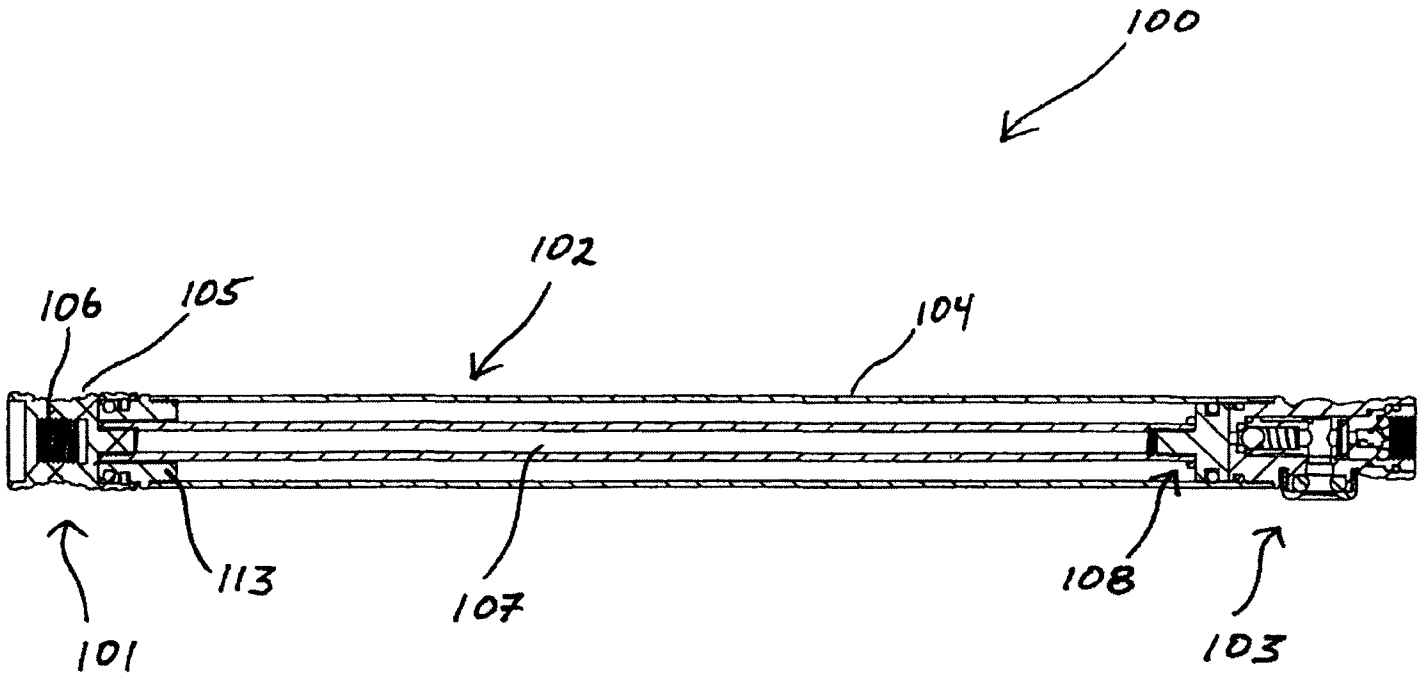
FIG. 4 illustrates a cross-sectioned side view of the exemplary dual function barrel pump from FIG. 3, in accordance with embodiments of the present invention.
Figure 4B:
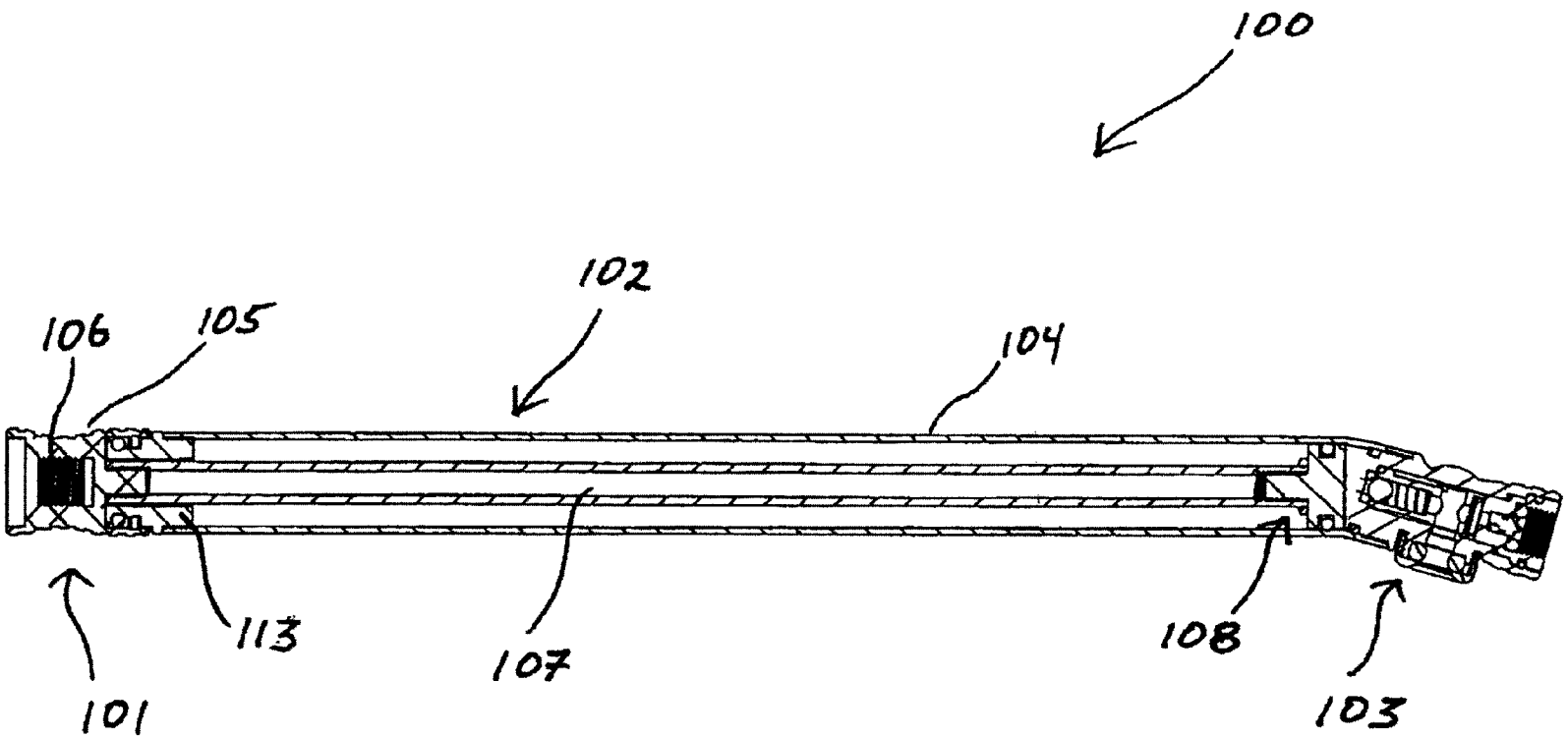

FIGS. 4A and 4B illustrate a cross-sectioned side view of exemplary embodiments of Applicant's dual function barrel pump from FIG. 3, in accordance with embodiments of the present invention. FIG. 4A shows a lance housing axially in line with barrel section 102. FIG. 4B shows a lance housing axially out of line with barrel section 102. The components of manual handle assembly 101 can be seen in cross-section and include: A hand grip 105, a pump rod 107, and a piston assembly 108. Hand grip 105 has an internally threaded feature and conical entry that will allow a comprises gas cartridge having a threaded neck portion to be axially stored in hand grip 105. Addition of a comprises gas cartridge (shown in FIG. 8B) into hand grip 105 will allow the user to hold a larger hand grip. A guide can 113 threads into the end of barrel section 102 and provides a guide for pump p rode 107 as well as an air inlet when manual handle assembly 100 is manually actuated in an outward stroke. A tubular barrel 104 houses part of handle assembly 101. Inflation head 103 comprises a plurality of components and will be detailed in enlarged view in FIGs. to follow.

Figure 5:
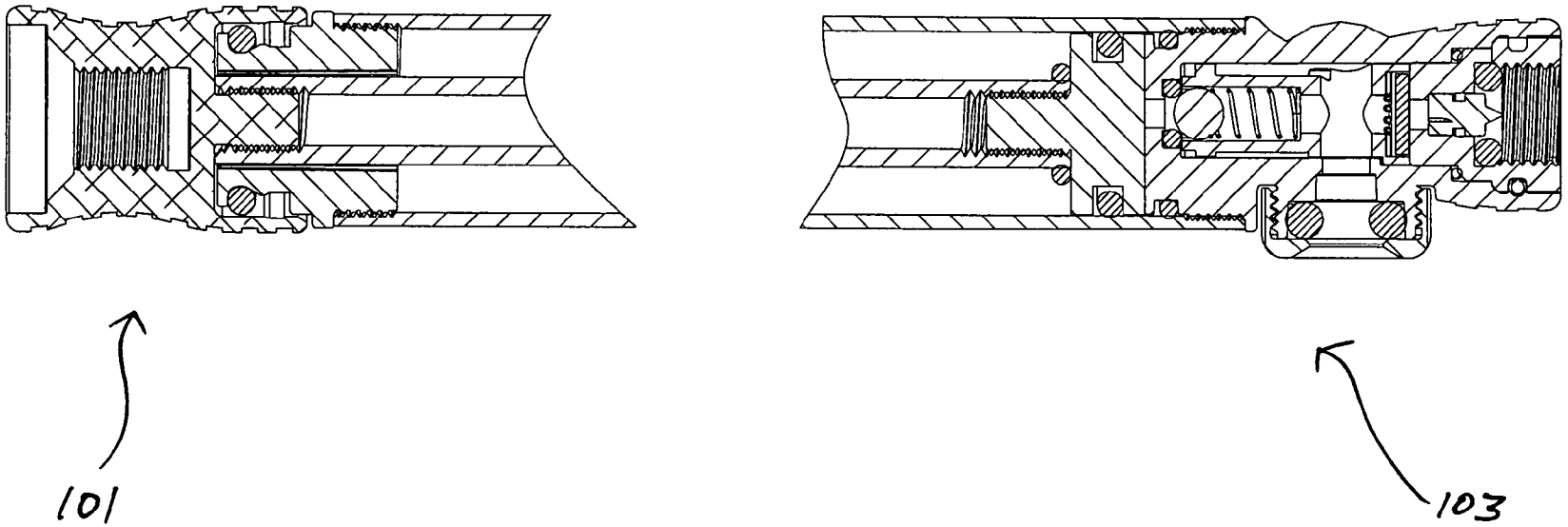
FIG. 5 illustrates an enlarged cross-sectioned side view of the end details from FIG. 4 while omitting the middle barrel section.

FIG. 5 illustrates an enlarged cross-sectioned side view of manual handle assembly 101 and inflation head 103 from FIG. 4 while omitting most of barrel section 102.

Figure 6:
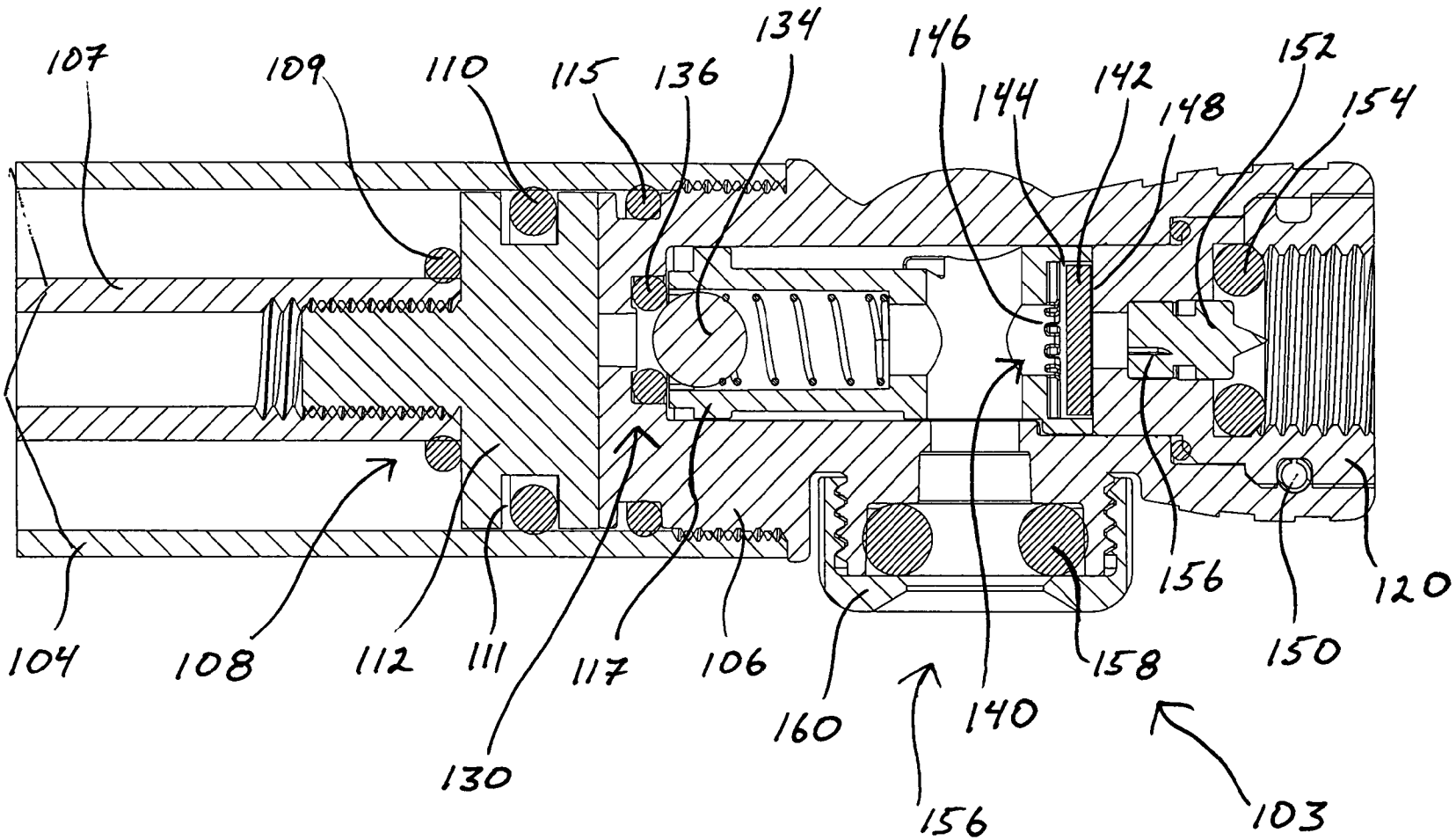
FIG. 6 illustrates an enlarged cross-sectioned side view of an exemplary inflation head, introduced from prior FIGS.

FIG. 6 illustrates an enlarged cross-sectioned side view of an exemplary inflation head 103, in accordance with a functional embodiment of the present invention. Piston assembly 108 can finally be seen with the enlarged clarity in this FIG. and includes a top-out cushion 109 and a piston seal 110 that situates within a seal retaining groove 111 as a feature in a piston 112. Pump rod 107 threadably attaches to piston 112. A dispensing body 106 is fluidly sealed to barrel 104 by a barrel seal 115.

Contained within dispensing body 106 are a check body 117 and a lance housing 120. Embodied as an in-line assembly, dispensing body 106 has a first one-way flow valve 130 normally in the closed position by a spring 132 biasing a rigid sphere 134 against a first check seal 136. Also embodied as an in-line assembly, dispensing body 106 has a second one-way flow valve 140 fluidly connecting check body 117 to lance housing 120. Second one-way flow valve 140 comprises a second check seal 142 loosely situated in a second seal nest 144. An array of radially oriented flow vents 146 prevent second check seal 142 from fluidly sealing gas flow incoming from lance housing 120, and a sealing face 148 prevents second check seal 142 from fluidly leaking gas flow outgoing to lance housing 120 from within dispensing body 106.

Figure 8A:
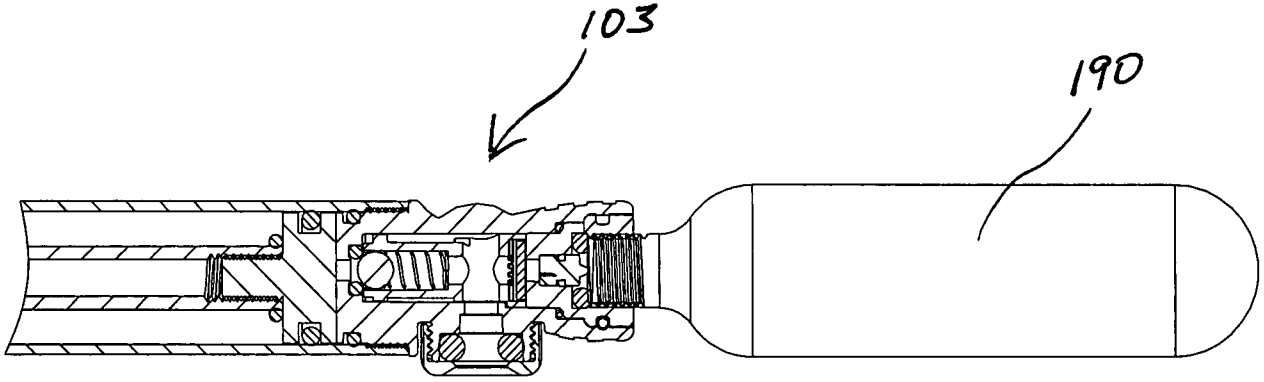
FIG. 8A illustrates an exemplary enlarged view of an inflation head threaded into a partial cross-sectioned side view of an inflation head, in accordance with an embodiment of the present invention.

Lance housing 120 from FIG. 6 fits within dispensing body 106 and is retained in position by a securing pin 150, exemplified as a roll pin. A puncture lance 152 is situated concentrically within the inner bore of lance housing 120 by an interference fit and is concentrically sealed by a lance seal 154. A lance gas path 156 allows for fluid connection between lance housing, into dispensing body 106. FIG. 8A will illustrate a compressed gas cartridge attached to inflation head 103.

A fluid outlet 156 fluidly connects with dispensing body 106 and comprises an outlet seal 158 and an outlet seal keeper 160. A variety of similar fluid outlets are common in the current art including versions that attach to either Presta or Schraeder valves or capable of adapting to both.

Figure 7B:
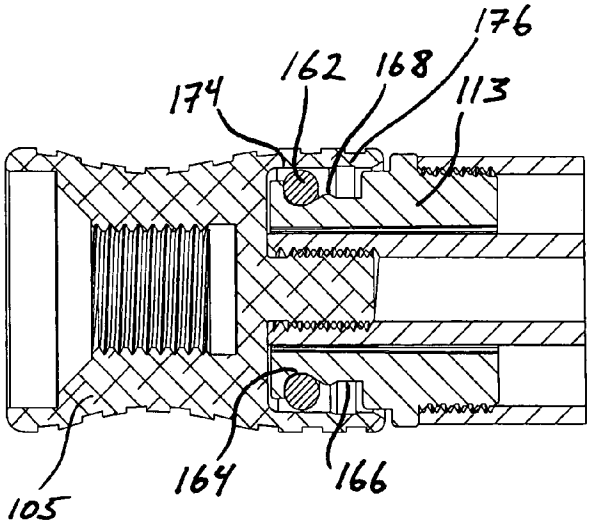
FIG. 7B illustrates a side cross-sectional view of a manual handle assembly in an unlocked and unsealed position, in accordance with an embodiment of the present invention.
Figure 7C:
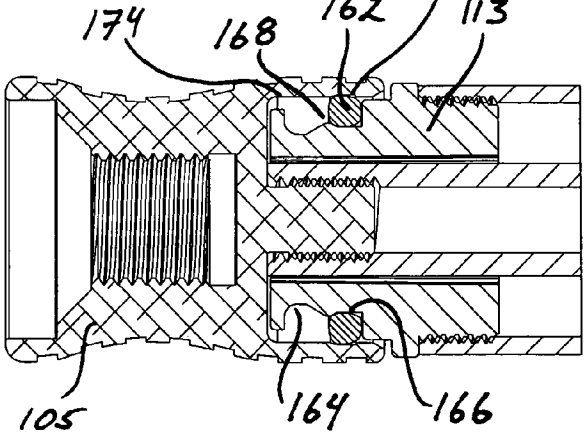
FIG. 7C illustrates a side cross-sectional view of a manual handle assembly in a locked and sealed position, in accordance with an embodiment of the present invention.
Figure 7A:
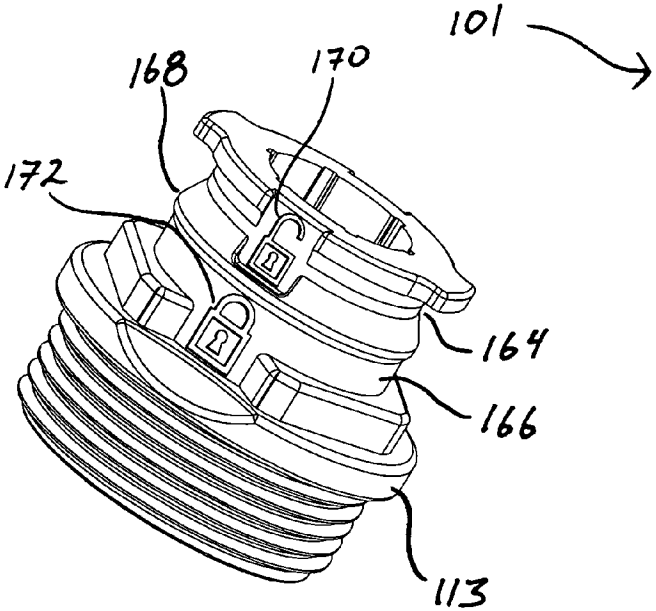
FIG. 7A illustrates an isometric view of an exemplary guide cap detailing lock and sealing features, in accordance with an embodiment of the present invention.

FIG. 7A illustrates an enlarged isometric view of guide cap 113, in accordance with an embodiment of the present invention. As mentioned as one of the objects and advantages, hand grip 105 locking and sealing means is accomplished through a simple, yet novel locking system. An unlock groove 164 is shown having a visual unlock symbol 170 resembling a padlock in an open position, thereby understandable by people of any language. A lock groove 166 is shown having a visual lock symbol 172 resembling a padlock in a closed position, thereby understandable by people of any language. Separating visual unlock symbol 170 and visual lock symbol 172 is a lock ridge 168.

FIG. 7B illustrates a side cross-sectional view of manual handle assembly 101 in an unlocked position, in accordance with an embodiment of the present invention. An elastomer ring 162 is residing in unlock groove 164 and not capable of physically dragging on an inside surface 174 of hand grip 105 because unlock groove 164 has a small enough diameter. A user can move freely move hand grip 105 to and from guide cap 113 with no dragging of elastomer ring 162.

A user actuates the locking and sealing means by separating hand grip 105 away from guide cap 113 and sliding elastomer ring 162 over lock ridge 168 and into lock groove 166. Upon closing hand grip 105 with guide cap 113, elastomer ring 162 engages with a recessed groove 176 that is incorporated into an inner diameter on hand grip 105. FIG. 7C illustrates manual handle assembly 101 in a locked and sealed position. Dirt, water, etc. will stay out of the pump and hand grip 105 will not migrate from its locked position until a user wants it separated. Additionally, even with a compressed gas cartridge threaded into hand grip 105 for stow (exemplified in FIG. 8B), the locking and sealing system will retain manual handle assembly 101 together.

Upon a user wanting hand grip 105 separated from guide cap 113, a gentle tug allows component separation as well as drags elastomer ring 162 over lock ridge 168 to reside in unlock groove 164. A user can freely use the manual pumping feature without elastomer ring interfering with the pumping action.

FIG. 8A illustrates a compressed gas cartridge 190 threadably engaged with inflation head 103. As is common in the art, the embodied method of dispensing compressed gas cartridge 190 is to completely thread together and then allow controlled gas release by slightly unthreading the threaded connection.

Figure 8B:
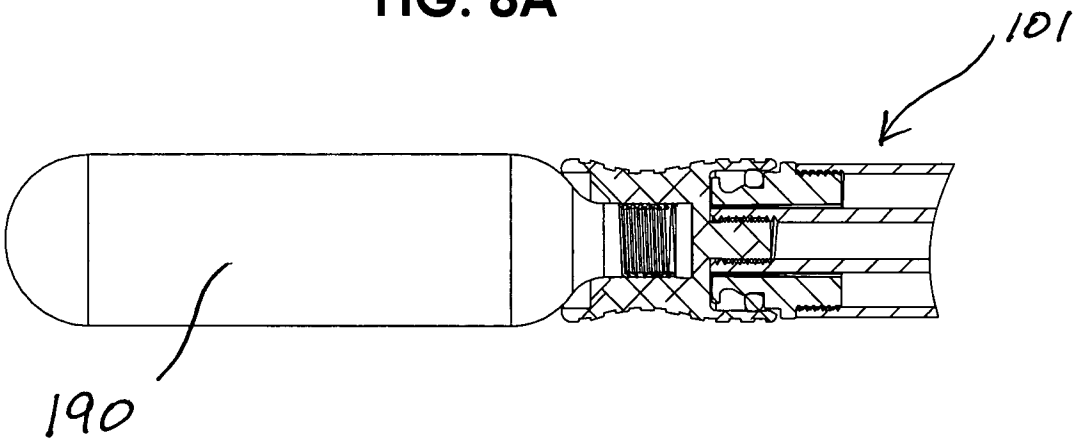
FIG. 8B illustrates an exemplary enlarged view of a manual handle assembly threadably engaged with a compressed gas cartridge for stow, in accordance with an embodiment of the present invention.

FIG. 8B illustrates a compressed gas cartridge 190 threadably engaged with manual handle assembly 101. Stowed compressed gas cartridge 190 threadably engages with internal threads in hand grip 105. A user can easily mount dual function barrel pump 102 to a frame or insert into a bag while additionally maintaining one or more compressed gas cartridges connected to the pump.

One skilled in the art of manual air pumping and dispensing compressed gas cartridges realizes that a handful of methods and hardware can literally be interchanged to accomplish identical or substantially similar functions without drifting from the causative principle of the representative teachings. According to the embodiments, each example having unique advantages and drawbacks in comparison to the other exemplified designs.

That said, to the extent that such modifications and variations do not depart from the spirit of the invention, they are intended to be included within the scope thereof which is limited only by a fair assessment of the following claims.

Having fully described the present invention and alternately preferred embodiments thereof in such clear and concise terms as to enable those skilled in the pertinent art to understand and practice the same without the need for undue experimentation, the invention claimed is:

1. A barrel style pump, comprising:

a tubular barrel comprising a first end, a second end, and a barrel axis extending between said first end of said tubular barrel and said second end of said tubular barrel;

a manual pump handle assembly disposed on the first end of said tubular barrel, said manual pump handle assembly comprising a hand grip, a piston, and connecting rod;

wherein said hand grip is threadedly formed to axially attach a first compressed gas cartridge thereto;

a dispensing head comprising an outlet port, wherein said dispensing head is disposed on the second end of said tubular barrel, wherein said dispensing head is threadedly formed to axially attach a second compressed gas cartridge thereto;

a lance housing disposed within said dispensing head, said lance housing formed to include an inner bore, said lance housing comprising a puncture lance disposed concentrically within said inner bore, a lance seal, and a lance gas path fluidly connecting said lance housing and said dispensing head;

a first one-way valve disposed within said dispensing head between said lance housing and said outlet port;

a second one-way valve disposed within said dispensing head between said second end of said tubular barrel and said outlet port; wherein the first and second one-way valves are coaxial with the barrel axis.

2. The barrel style pump of claim 1, wherein:

said outlet port-can fluidly adapt to a tire valve.

3. The barrel style pump of claim 1, wherein:

said manual pump handle assembly is connected to said first end of said tubular barrel;

said manual pump handle comprises a threaded socket allowing said attached first compressed gas cartridge to be used as an extension of said pump handle.

4. The barrel style pump of claim 3, wherein:

said dispensing head is attached to said second end of said tubular barrel; and said dispensing head comprises a threaded lance housing.

5. The barrel style pump of claim 4, wherein said first compressed gas cartridge is axially aligned with said barrel axis.

6. The barrel style pump of claim 5, wherein said first compressed gas cartridge comprises said extension of said manual pump handle.

7. The barrel style pump of claim 5, wherein said second compressed gas cartridge is axially aligned with said barrel axis.

* * * * *